US010920941B1

(12) United States Patent
Shan et al.

(10) Patent No.: US 10,920,941 B1
(45) Date of Patent: Feb. 16, 2021

(54) LED MESHWORK LAMP AND PRODUCTION METHOD THEREOF

(71) Applicant: Zhuhai Bojay Electronics Co. Ltd., Guangdong (CN)

(72) Inventors: Xiwan Shan, Guangdong (CN); Tuxiu Yang, Guangdong (CN); Yundong Ai, Guangdong (CN); Jie Zhang, Guangdong (CN); Qunlin Li, Guangdong (CN); Qiming Liu, Guangdong (CN); Su Yan, Guangdong (CN); Yanyong Liu, Guangdong (CN); Junchao He, Guangdong (CN); Jiahui Cai, Guangdong (CN); Yue Chen, Guangdong (CN)

(73) Assignee: Zhuhai Bojay Electronics Co. Ltd., Guangdong (CN)

( * ) Notice: Subject to any disclaimer, the term of this patent is extended or adjusted under 35 U.S.C. 154(b) by 0 days.

(21) Appl. No.: 16/888,290

(22) Filed: May 29, 2020

(30) Foreign Application Priority Data

Sep. 6, 2019 (CN) ..... 2019 1 0844281

(51) Int. Cl.
*F21S 4/15* (2016.01)
*F21V 31/00* (2006.01)
(Continued)

(52) U.S. Cl.
CPC ..... *F21S 4/15* (2016.01); *F21K 9/90* (2013.01); *F21V 19/002* (2013.01);
(Continued)

(58) Field of Classification Search
CPC ..... F21S 4/15; F21V 23/001; F21V 31/005; F21V 19/002; F21K 9/90; F21Y 2115/10; F21Y 2105/12
See application file for complete search history.

(56) References Cited

U.S. PATENT DOCUMENTS

2014/0009074 A1* 1/2014 Chen ..... F21V 23/001 315/185 R
2015/0077999 A1* 3/2015 Chen ..... F21V 23/001 362/249.08

(Continued)

FOREIGN PATENT DOCUMENTS

WO WO-2019-041745 A1 3/2019

OTHER PUBLICATIONS

U.S. Appl. No. 16/888,222 Non-Provisional Application, filed May 29, 2020, 29 pages.

(Continued)

*Primary Examiner* — Tracie Y Green
(74) *Attorney, Agent, or Firm* — Adsero IP

(57) ABSTRACT

The present disclosure discloses an LED meshwork lamp and a production method thereof. The LED meshwork lamp includes: at least two LED string lights which are arranged in parallel along a lateral direction, the LED string light including a first conducting wire, a second conducting wire, a third conducting wire, a plurality of SMD LEDs and a plurality of encapsulation colloids; at least two auxiliary wires, the at least two auxiliary wires and the at least two LED string lights being arranged alternately one by one in parallel and spaced apart along the lateral direction; and a plurality of connecting members configured to interlace the plurality of lamp beads of each LED string light with two auxiliary wires on both sides of the LED string light to form a meshwork structure.

10 Claims, 7 Drawing Sheets

(51) Int. Cl.

| | |
|---|---|
| ***F21V 23/00*** | (2015.01) |
| ***F21K 9/90*** | (2016.01) |
| ***F21V 19/00*** | (2006.01) |
| *F21Y 105/12* | (2016.01) |
| *F21Y 115/10* | (2016.01) |

(52) U.S. Cl.
CPC ..... *F21V 23/001* (2013.01); *F21V 31/005* (2013.01); *F21Y 2105/12* (2016.08); *F21Y 2115/10* (2016.08)

(56) References Cited

U.S. PATENT DOCUMENTS

2018/0119929 A1* 5/2018 Weiss ..... H02G 3/0462
2019/0368670 A1* 12/2019 Gao ..... F21V 23/001

OTHER PUBLICATIONS

U.S. Appl. No. 16/888,282 Non-Provisional Application, filed May 29, 2020, 36 pages.
U.S. Appl. No. 16/888,286 Non-Provisional Application, filed May 29, 2020, 36 pages.
U.S. Appl. No. 16/888,296 Non-Provisional Application, filed May 29, 2020, 39 pages.
GB Application No. GB2006270.9, Examination Report dated Jun. 12, 2020, 1 page.
GB Application No. GB2006270.9, Search Report dated Jun. 11, 2020, 1 page.
U.S. Appl. No. 17/002,105 Non-Provisional Application, filed Aug. 25, 2020, 72 pages.
GB Application No. GB2006267.5, Examination Report dated Jun. 12, 2020, 2 pages.
GB Application No. GB2007273.2, Examination Report dated Jun. 15, 2020, 2 pages.
GB Application No. GB2006271.7, Examination Report dated Jun. 12, 2020, 2 pages.

* cited by examiner

LED MESHWORK LAMP AND PRODUCTION METHOD THEREOF

TECHNICAL FIELD

The present disclosure relates to the field of lighting technology, and particularly to an LED meshwork lamp and a production method thereof.

BACKGROUND

Most traditional decorative lightings are provided with a plurality of spaced bulbs arranged on a long conducting wire, and the entire string is powered on and may have decorative effectives of lighting and flashing with one end of the conducting wire plugged into the power supply. However, such traditional string has a more monotonous lighting effect due to the linearly arranged bulbs; and meanwhile, it is troublesome and inconvenient to wind the string around some place such as a Christmas tree in use, or recycle the string after use.

In modern times, various designs of meshwork lamps with different structural forms are developed, which design the whole structure of the decorative lighting as a meshwork structure, to enable all the bulbs and conducting wires to integrally cove the decorative sites (such as a Christmas tree and a bush) with more efficient coverage. The existing meshwork lamp wire is a wire covered with transparent PVC and a multi-strand wire; and the lamp bead is a traditional direct plug-in LED lamp. Accordingly, the lamp is welded one by one, the production efficiency is low and the consistency of the quality is low.

SUMMARY

In view of this, the technical problem to be solved by the present disclosure is to provide an LED meshwork lamp with high production efficiency and good product quality. Another technical problem to be solved by the present disclosure is to provide an LED meshwork lamp production method.

In order to solve the above technical problem, an LED meshwork lamp is provided by the present disclosure, including:

at least two LED string lights arranged in parallel along a lateral direction, wherein each LED string light includes a first conducting wire, a second conducting wire, a third conducting wire, a plurality of Surface Mounted Devices (SMD) LEDs and a plurality of encapsulation colloids; the first conducting wire, the second conducting wire and the third conducting wire are arranged in parallel along a lateral direction or intertwisted together; the first conducting wire, the second conducting wire and the third conducting wire all include a conducting wire core and an insulation layer covering a surface of the conducting wire core; the insulation layer on the first conducting wire is removed at intervals of a predetermined length along an axial direction of the first conducting wire to form a plurality of first welding spots, the insulation layer on the second wire is removed at intervals of the predetermined length along an axial direction of the second conducting wire to form a plurality of second welding spots; positions of the plurality of the second welding spots correspond to positions of the plurality of the first welding spots one to one to form a plurality of lamp-welding areas; the plurality of the SMD LEDs are respectively disposed in the plurality of the lamp-welding areas, two welding legs of each of the SMD LEDs are respectively welded to the first welding spot and the second welding spot of a corresponding lamp-welding area; the plurality of the SMD LEDs are connected in a parallel mode, a series mode or a hybrid mode; the plurality of the encapsulation colloids respectively cover the plurality of the SMD LEDs and surfaces of portions of the third conducting wire corresponding to positions of the plurality of the SMD LEDs, to form a plurality of lamp beads;

at least two auxiliary wires, the at least two auxiliary wires and the at least two LED string lights being alternately arranged one by one in parallel and spaced apart along the lateral direction; and a plurality of connecting members, configured to interlace the plurality of the lamp beads of each LED string light to the two auxiliary wires on both sides of the each LED string light to form a meshwork structure.

The LED meshwork lamp provided by the present disclosure is suitable for automatic production, which is beneficial for reducing labor cost, reducing labor intensity, effectively improving production efficiency, and improving the quality of the finished product of the string. Moreover, the LED string light has three conducting wires. When the LED string light is a series string, the third conducting wire may increase the intensity of the LED string light to prevent the SMD LED from falling off when pulling the LED string light; when the LED lamp string is a string in parallel, the third conducting wire is connected to the first conducting wire or the second conducting wire in parallel, which is beneficial for reducing the voltage decay speed, such that the LED string light is not limited by the power supply.

In an embodiment, positive-pole and negative-pole positions of two adjacent SMD LEDs are arranged in an opposite direction, and the first conducting wire and the second conducting wire between every two adjacent SMD LEDs are alternately cut off, such that a plurality of the SMD LEDs are connected in series, and wire ends formed by cutting the first conducting wire and the second conducting wire are encapsulated in the encapsulation colloid.

In an embodiment, every at least two adjacent SMD LEDs constitute one light-emitting unit, positive-pole and negative-pole positions of each SMD LED in each light-emitting unit are arranged in a same direction, positive-pole and negative-pole positions of two adjacent light-emitting units are arranged in an opposite direction; the first conducting wire and the second conducting wire between every two adjacent light-emitting units are alternately cut off, such that the plurality of the SMD LEDs are connected in a hybrid mode, and wire ends formed by cutting the first conducting wire and the second conducting wire are encapsulated in the encapsulation colloid.

In an embodiment, positive-pole and negative-pole positions of the plurality of the SMD LEDs are arranged in a same direction, such that the plurality of the SMD LEDs are connected in parallel, and the third conducting wire is connected to the first conducting wire or the second conducting wire through at least one jumper wire bridged between the third conducting wire and the first conducting wire or the second conducting wire.

In an embodiment, the connecting member includes a fixing portion which is provided with a snapping slot matching the lamp bead, the lamp bead and the auxiliary wire are snapped into the snapping slot.

In an embodiment, the lamp bead and the auxiliary wire are fixed to the snapping slot by glue.

In an embodiment, the connecting member further includes a decoration portion, and the decoration portion is connected to the fixing portion.

In an embodiment, the first conducting wire, the second conducting wire, and the third conducting wire are enamel-covered wires or rubber-covered wires.

A production method for an LED meshwork lamp is provided, including:

providing at least two LED string lights which are arranged in parallel along a lateral direction; each LED string light includes a first conducting wire, a second conducting wire, a third conducting wire, a plurality of Surface Mounted Devices (SMD) LEDs and a plurality of encapsulation colloids; the first conducting wire, the second conducting wire and the third conducting wire are arranged in parallel along a lateral direction or intertwisted together; the first conducting wire, the second conducting wire and the third conducting wire all include a conducting wire core and an insulation layer covering a surface of the conducting wire core; the insulation layer on the first conducting wire is removed at intervals of a predetermined length in an axis direction of the first conducting wire to form a plurality of first welding spots, the insulation layer on the second conducting wire is removed at intervals of a predetermined length in an axis direction of the second conducting wire to form a plurality of second welding spots; positions of the plurality of the second welding spots correspond to positions of the plurality of the first welding spots one to one, to form a plurality of lamp-welding areas; the plurality of the SMD LEDs are respectively disposed in the plurality of the lamp-welding areas, and two welding legs of each SMD LED are respectively welded to the first welding spot and the second welding spot of a corresponding lamp-welding area; the plurality of SMD LEDs are connected in a parallel mode, a series mode or a hybrid mode; the plurality of the encapsulation colloids respectively cover the plurality of the SMD LEDs and surfaces of portions of the third conducting wire corresponding to positions of the plurality of the SMD LEDs to form a plurality of lamp beads;

providing at least two auxiliary wires, wherein the at least two auxiliary wires and the at least two and the at least two LED string lights are alternately arranged one by one and spaced apart along the lateral direction; and interlacing the plurality of the lamp beads of each LED string light with the two auxiliary wires on both sides of the LED string light along an axial direction of the LED string light in sequence, to form a meshwork structure.

In an embodiment, the providing at least two LED string lights includes:

wiring the first conducting wire and the second conducting wire in parallel through wiring mechanisms of the first conducting wire and the second conducting wire;

transporting the first conducting wire and the second conducting wire to wire-stripping stations by a wire transportation mechanism, removing insulation layer on the first conducting wire at intervals of a predetermined length through a wire-stripping mechanism to form a first welding spot; removing insulation layer on the second conducting wire at intervals of a predetermined length through a wire-stripping mechanism to form a second welding spot; and a position of the first welding spot corresponds to a position of the second welding spot;

transporting the first welding spot and the second welding spot to spot-welding material stations through the wire transportation mechanism, and coating a welding material on surfaces of the first welding spot and the second welding spot through the spot-welding material mechanism;

transporting the first welding spot and the second welding spot coated with the welding material on the surfaces thereof to LED mounting stations through the wire transportation mechanism, and placing two welding legs of each SMD LED on the first welding spot and the second welding spot respectively through an LED placement mechanism;

transporting the each SMD LED placed on the first welding spot and the second welding spot to a welding station through the wire transportation mechanism, and welding the two welding legs of the each SMD LED to the first welding spot and the second welding spot respectively through a welding mechanism;

transporting the each welded SMD LED to a welding detection station through the wire transportation mechanism, to detect a welding quality of the each SMD LED through a welding detection mechanism;

wiring the third conducting wire in parallel to the first conducting wire and the second conducting wire through a wiring mechanism of the third conducting wire; transporting the each detected SMD LED and the third conducting wire to a first encapsulation station through the wire transportation mechanism; encapsulating the each SMD LED and a portion of the third conducting wire corresponding to a position of the each SMD LED into the encapsulation colloid through a first encapsulation mechanism, to form a lamp bead;

transporting the lamp bead to a cutting station through the wire transportation mechanism, and determining through a wire cutting mechanism whether to cut wires; if yes, the first conducting wire or the second conducting wire between two adjacent lamp beads is cut; if not, the first conducting wire or the second conducting wire between the two adjacent lamp beads is not cut; and transporting the lamp bead to a second encapsulation station through the wire transportation mechanism; if the first conducting wire or the second conducting wire between the two adjacent lamp beads is cut, encapsulating, through a second encapsulation mechanism, the lamp bead and a wire end formed by cutting the first conducting wire or the second conducting wire together in the encapsulation colloid.

The advantageous effects of the additional features of the present disclosure will be illustrated in the embodiments of the specification.

BRIEF DESCRIPTION OF THE DRAWINGS

FIGS. 10-12 are schematic diagrams showing a production method for an LED meshwork lamp according to an embodiment of the present disclosure, in which FIG. 10 is a schematic diagram of an LED string light and the auxiliary wire after wiring;

FIG. 11 is a schematic diagram of a first row of encapsulation colloids connected to an auxiliary wire on one side;

FIG. 12 is a schematic diagram of the first row of encapsulation colloids connected to an auxiliary wire on the other side;

DESCRIPTION OF THE REFERENCE SIGNS

100, LED meshwork lamp; 110, LED string light; 111, first conducting wire; 112, second conducting wire; 113, third conducting wire; 114, Surface Mounted Devices (SMD) LED; 115, encapsulation colloid; 116, jumper wire; 120, auxiliary wire; 130, connecting member; 131, fixing portion; 131*a*, snapping slot; 132, decoration portion.

DETAILED DESCRIPTION OF THE EMBODIMENTS

The disclosure will be described in detail below with reference to the drawings in conjunction with the embodiments. It should be noted that the embodiments and the features in the following embodiments may be combined with each other in case of no conflict.

The terms "up", "down", "left" and "right" in the present embodiment are merely used for the purpose of description, and are not intended to limit the scope of the disclosure, and the change or adjustment of the relative relationship thereof should be regarded as the scope of the present disclosure.

Figure 1:
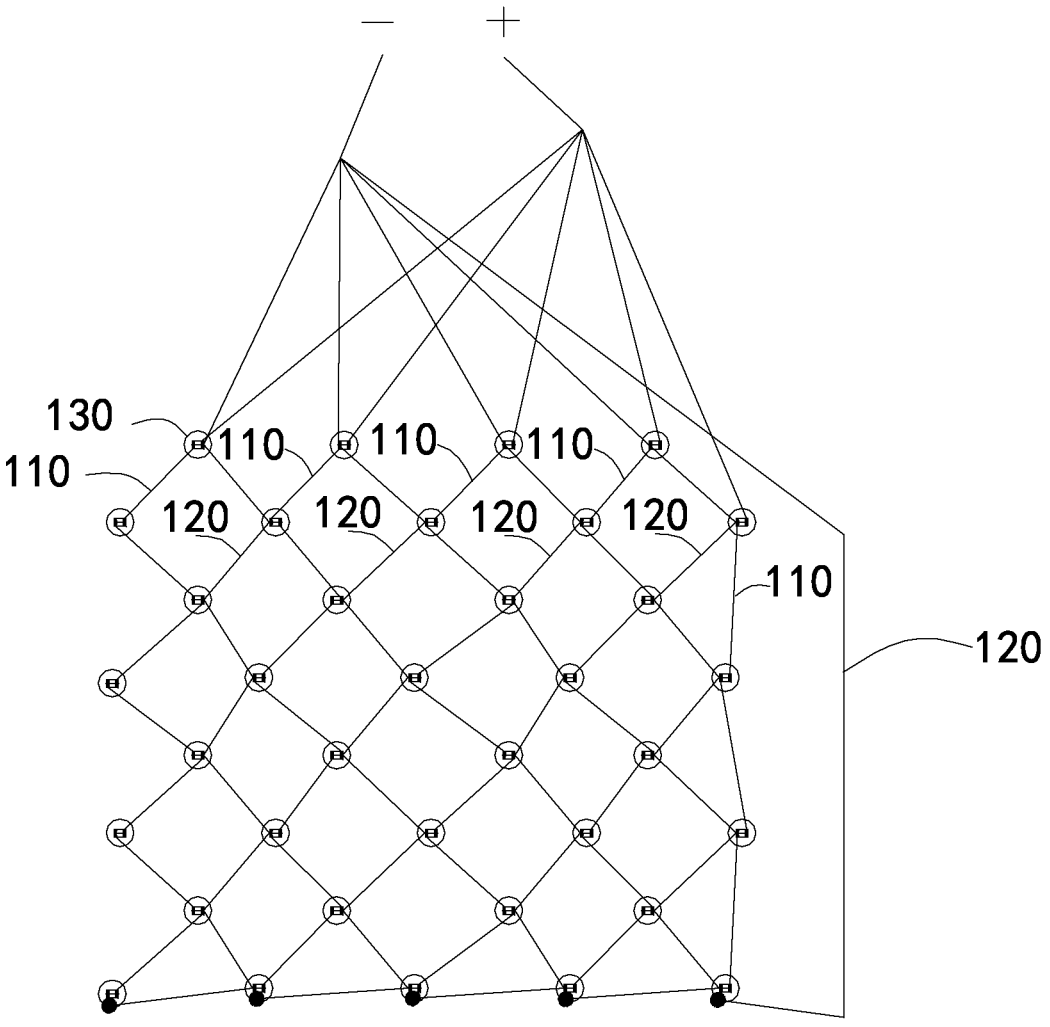
FIG. 1 is a schematic structure diagram of an LED meshwork lamp according to an embodiment I of the present disclosure.
Figure 2:
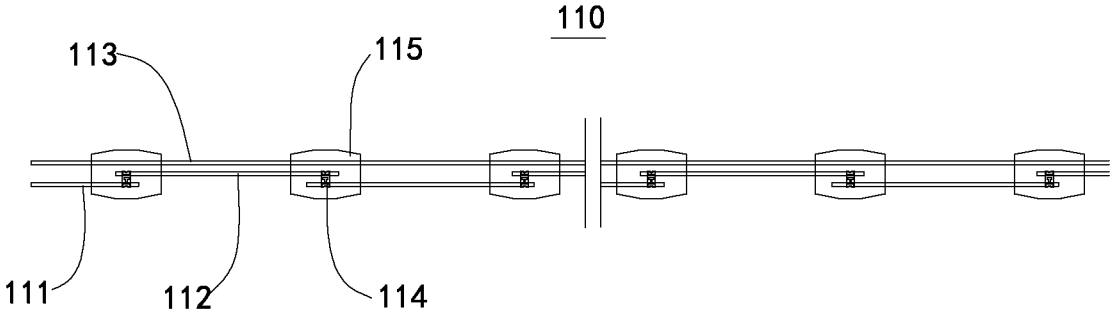
FIG. 2 is a schematic structure diagram of an LED string light of the LED meshwork lamp according to the embodiment I of the present disclosure.
Figure 3:
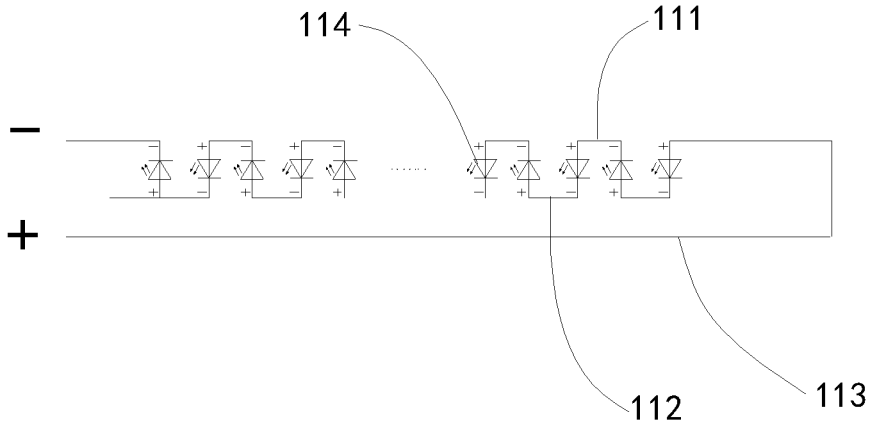
FIG. 3 is a schematic circuit diagram of the LED string light of the LED meshwork lamp according to the embodiment I of the present disclosure.

FIG. 1 is a schematic structure diagram of an LED meshwork lamp 100 according to embodiment I of the present disclosure; FIG. 2 is a schematic structure diagram of an LED string light 110 of the LED meshwork lamp 100 according to embodiment I of the present disclosure; and FIG. 3 is a schematic circuit diagram of the LED string light 110 of the LED meshwork lamp 100 according to embodiment I of the present disclosure. As shown in FIGS. 1-3, the LED meshwork lamp 100 include at least two LED string lights 110 (in the present embodiment, the number of the LED string light 110 is five), at least two auxiliary wires 120 (in the preset embodiment, the number of the auxiliary wires 120 is five) and several connecting members 130.

The at least two LED string lights 110 are arranged in parallel and spaced apart in the lateral direction. The LED string light 110 includes a first conducting wire 111, a second conducting wire 112, a third conducting wire 113, a number of SMDLEDs 114, and a number of encapsulation colloids 115. The first conducting wire 111, the second conducting wire 112 and the third conducting wire 113 are arranged in parallel or intertwisted together; and the first conducting wire 111, the second conducting wire 112, and the third conducting wire 113 all include a wire core (not shown) and an insulation layer (not shown) covering the surface of the wire core. The first conducting wire 111, the second conducting wire 112, and the third conducting wire 113 in the present embodiment may be rubber-covered wires or enamel-covered wires. The insulation layer on the first conducting wire 111 is removed at intervals of a predetermined length along an axial direction of the first conducting wire 111 to form a plurality of first welding spots (not shown); and similarly, the insulation layer on the second conducting wire 112 is removed at intervals of a predetermined length along an axial direction of the second conducting wire 112 to form a plurality of second welding spots (not shown). The positions of the plurality of the second welding spots correspond to the positions of the plurality of first welding spots one to one, to form a plurality of lamp-welding areas. The plurality of SMD LEDs 114 are respectively disposed in the plurality of lamp-welding areas, and two welding legs of the SMD LED 114 are respectively welded on the first welding spot and the second welding spot of the corresponding lamp welding region. The positive-pole and the negative-pole positions of two adjacent SMD LEDs 114 are arranged in an opposite direction, and the first conducting wire 111 and the second conducting wire 112 between every two adjacent SMD LEDs 114 are alternately cut off, that is, the first conducting wire 111 between the previous two adjacent SMD LEDs 114 is cut off, while the second conducting wire 112 therebetween is not cut off; then the first conducting wire 111 between the next two adjacent SMD LEDs 114 is not cut off, while the second conducting wire 112 therebetween is cut off, which cycle repeats, so that a plurality of SMD LEDs 114 are connected in series. The encapsulation colloid 115 respectively covers the surface of the SMD LED 114 and the surface of the portion of the third conducting wire 113 corresponding to the position of the SMD LED 114, to form a lamp bead.

FIG. 3 is a schematic circuit diagram of the LED string light according to embodiment I of the present disclosure. In use, one end of the first conducting wire 111 is electrically connected to one end of the third conducting wire 113; the other end of the first conducting wire 111 is connected to the negative pole of a driving power supply (not shown) and the other end of the third conducting wire 113 is connected to the positive pole of the driving power supply (not shown).

At least two auxiliary wires and at least two LED string lights are alternately arranged one by one in parallel and spaced apart in the lateral direction. The main function of the auxiliary wire 120 is to form a meshwork structure with the LED string light 110. Preferably, the auxiliary wire 120 is a conducting wire, and a termination of one end of the auxiliary wire 120 is connected to a termination of one end of the third conducting wire 113. In use, a termination of the other end of the auxiliary wire 120 is connected to the negative pole of the driving power supply, and the termination of the other end of the third conducting wire 113 is connected to the positive pole of the driving power supply.

Figure 4:
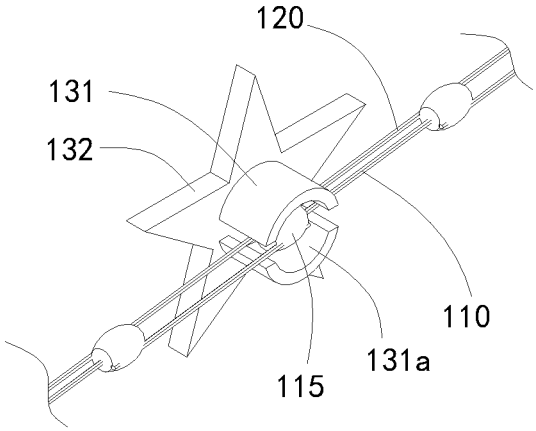
FIG. 4 is a schematic connection diagram showing a connection among a connecting member, an encapsulation colloid and an auxiliary wire of the LED meshwork lamp according to the embodiment I of the present disclosure.

The connecting member 130 is used for interlacing the plurality of the encapsulation colloids 115 of each LED string light 110 with the two auxiliary wires 120 on both sides of the LED string light 110 to form a meshwork structure. In an embodiment, as shown in FIG. 4, the connecting member 130 includes a fixing portion 131. The fixing portion 131 is provided with a snapping slot 131 matching the encapsulation colloid 115. The encapsulation colloid 115 and the auxiliary wire 120 are snapped into the snapping slot 131*a*, thereby the encapsulation colloid 115 is connected to the auxiliary wire 120. In order to prevent the connecting member 130 from departing, the encapsulation colloid 115 and the auxiliary wire 120 are fixed to the snapping slot 131*a* by glue. In an embodiment, the connecting member 130 further includes a decoration portion 132 that is connected to the fixing portion 131. The shape of the decoration portion 132 may be a star, a triangle, or the like.

The LED meshwork lamp 100 provided by the present disclosure may be powered by a high voltage power supply (such as a 220V power supply). Moreover, the third conducting wire 113 is connected to the first conducting wire 111 and the second conducting wire 112 through the encapsulation colloid 115, which is beneficial for increasing the strength of the LED string light 110 and preventing the SMD LED 114 from falling off when the LED string light 110 is pulled.

Moreover, the exterior of the lamp bead is covered with a connecting member 130 to increase the aesthetics of the string product and the life of the product.

Figure 5:
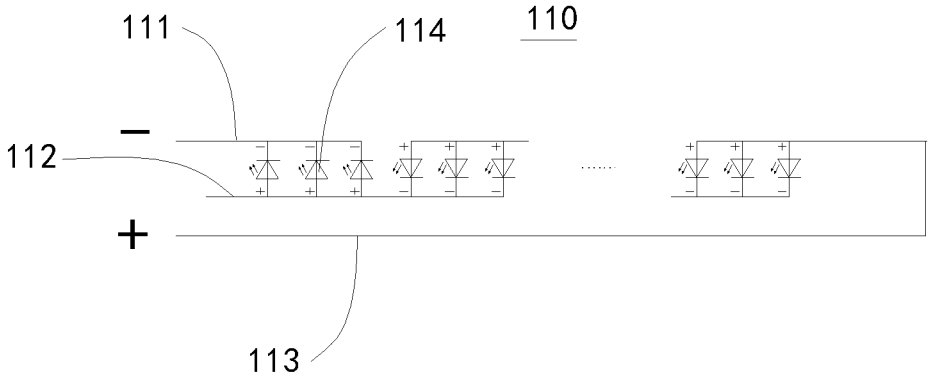
FIG. 5 is a schematic circuit diagram of an LED string light of an LED meshwork lamp according to an embodiment II of the present disclosure.

FIG. 5 is a schematic circuit diagram of the LED string light 110 of the LED meshwork lamp 100 in embodiment II of the present disclosure. In contrast to the embodiment I, the structure of the LED string light 110 in the present embodiment is substantially the same as that in the embodiment I, except that every at least two adjacent SMD LEDs 114 (there are four SMD LEDs in the present embodiment) form one light-emitting unit, and the SMD LEDs 114 in each light-emitting unit are connected in parallel. The positive-pole and negative-pole of two adjacent light emitting units are arranged in an opposite direction, and the first conducting wire 111 and the second conducting wire 112 between every two adjacent light-emitting units are alternately cut off, such that the plurality of SMD LEDs 114 are connected in a hybrid mode with parallel connection before series connection.

The LED string light 110 of the LED meshwork lamp 100 in the embodiment is a hybrid string, and may be powered by a middle-high voltage power supply (such as a 110V power supply). Moreover, the third conducting wire 113 is connected to the first conducting wire 111 and the second conducting wire 112 through the encapsulation colloid 115, which is beneficial for increasing the strength of the LED string light 110 and preventing the SMD LED 114 from falling off when the LED string light 110 is pulled.

Figure 6:
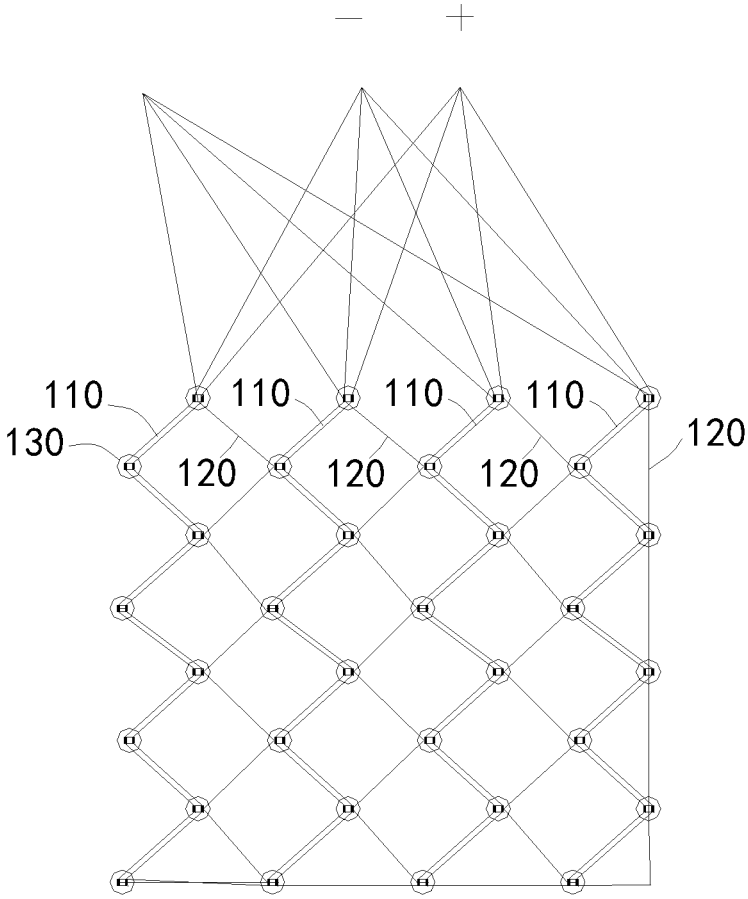
FIG. 6 is a schematic structure diagram of an LED meshwork lamp according to an embodiment III of the present disclosure.
Figure 7:
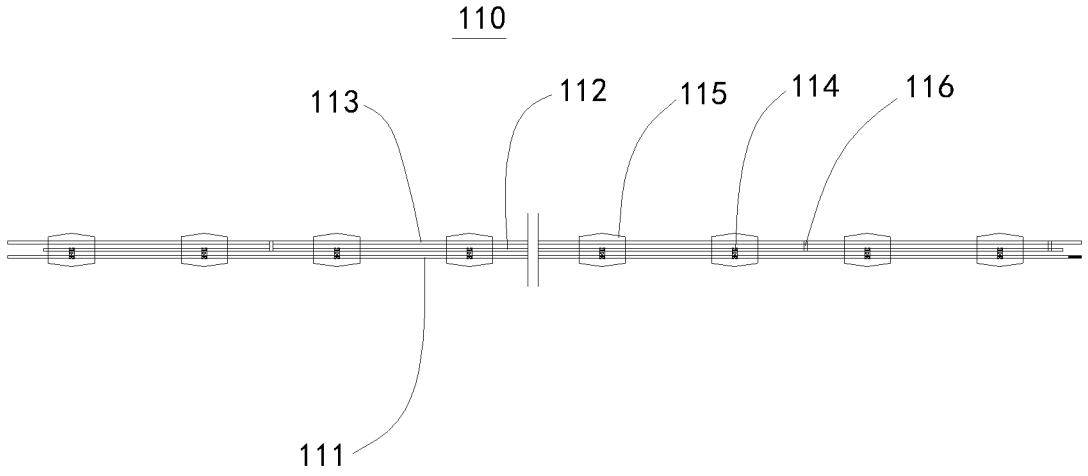
FIG. 7 is a schematic structure diagram of an LED string light of the LED meshwork lamp according to the embodiment III of the present disclosure.
Figure 8:
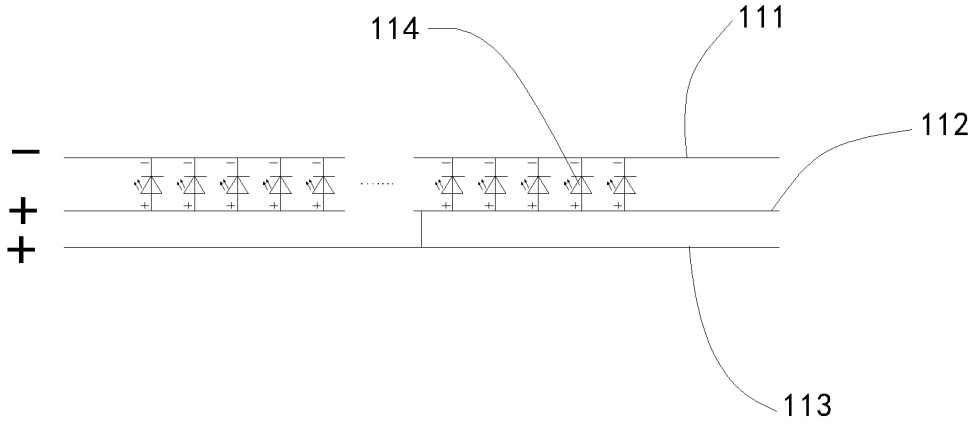
FIG. 8 is a schematic circuit diagram of the LED string light of the LED meshwork lamp according to the embodiment III of the present disclosure.

FIG. 6 is a schematic structure diagram of an LED meshwork lamp 100 according to an embodiment III of the present disclosure; FIG. 7 is a schematic structure diagram of an LED string light 110 of the LED meshwork lamp 100 according to the embodiment III of the present disclosure; and FIG. 8 is a schematic circuit diagram of the LED string light 110 of the LED meshwork lamp 100 according to the embodiment III of the present disclosure. As shown in FIGS. 6-8, the LED meshwork lamp 100 in the present embodiment has substantially the same structure as the LED meshwork lamp 100 of the embodiment I, except that the plurality of SMD LEDs 114 are connected in parallel through the second conducting wire 112 and the first conducting wire 111, and the third conducting wire 113 is connected to the first conducting wire 111 or the second conducting wire 112 through at least one jumper wire 116.

The LED string light 110 of the LED meshwork lamp 100 in the present embodiment is a parallel lamp string, and may be powered by a low voltage power supply (such as a 3V power supply). Moreover, the third conducting wire 113 is connected to the second conducting wire 112 in parallel, which is equivalent to increasing the cross-sectional area of the second conducting wire 112, thereby effectively reducing the voltage attenuation, and benefitting the improvement of the light-emitting effect. Moreover, the third conducting wire 113 is connected to the first conducting wire 111 and the second conducting wire 112 through the encapsulation colloid 115, which is beneficial for increasing the strength of the LED string light 110 and preventing the SMD LED 114 from falling off when the LED string light 110 is pulled.

Figure 9:
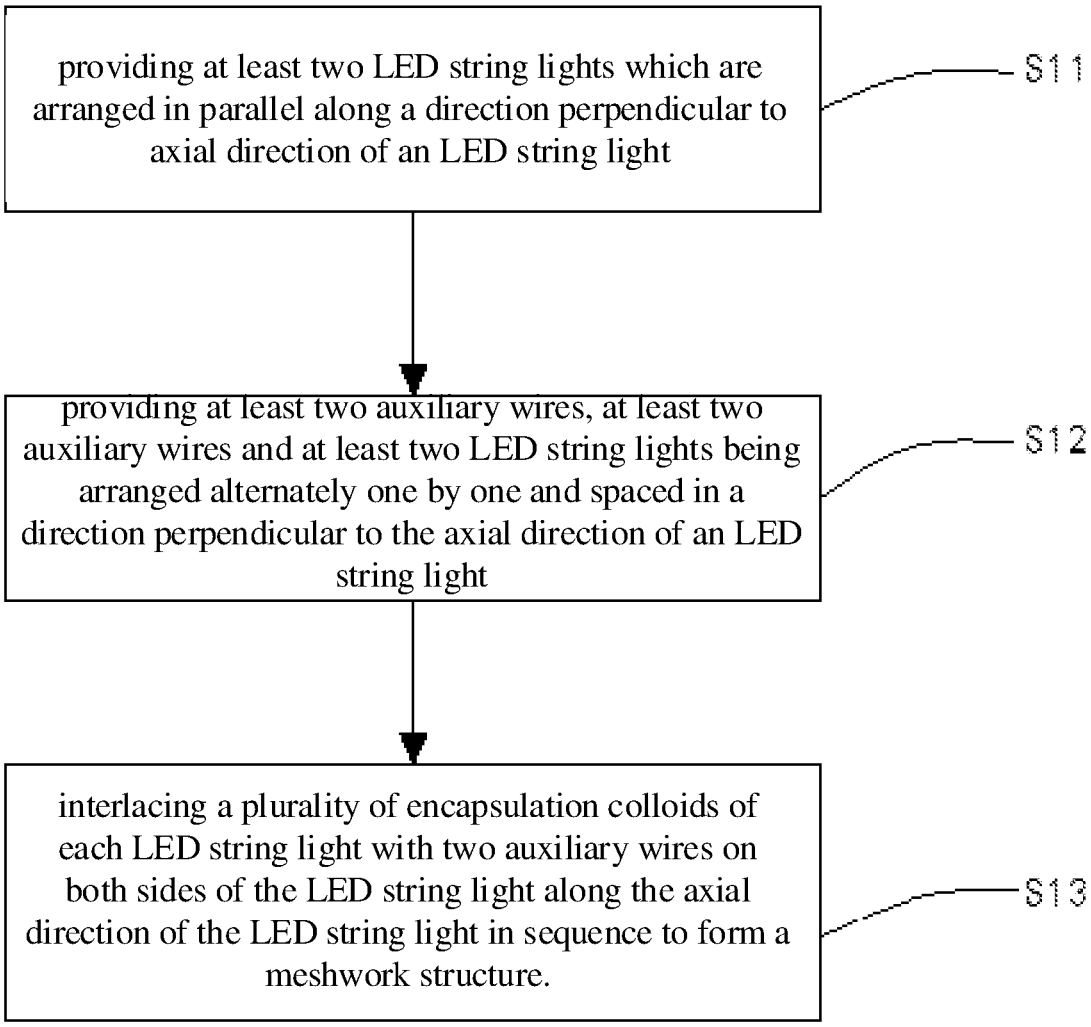
FIG. 9 is a flow chart of an LED meshwork lamp production method according to an embodiment of the present disclosure.

In another embodiment of the present disclosure, a production method for the above-mentioned LED meshwork lamp 100 is provided. As shown in FIG. 9, the production method includes the following steps.

Step S11: at least two LED string lights 110 are provided, which are arranged in parallel along a lateral direction.

Figure 10:
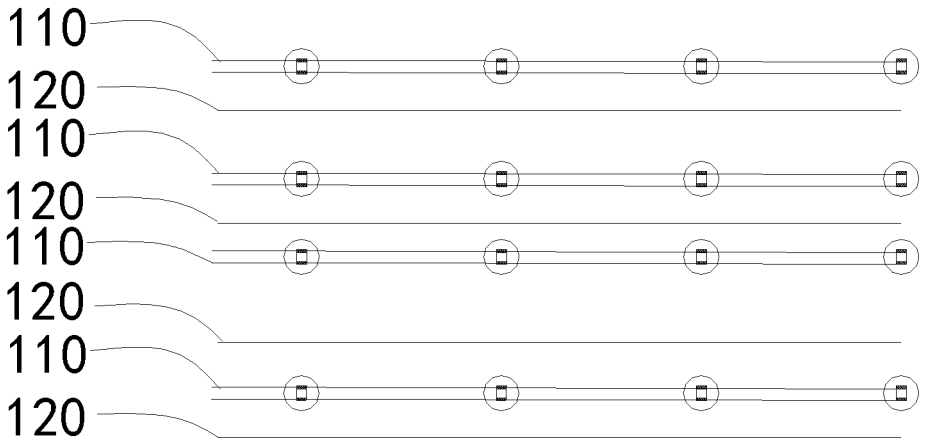

Step S12: at least two auxiliary wires 120 are provided, the at least two auxiliary wires 120 and at least two LED string lights are arranged alternately one by one in parallel and spaced apart in the lateral direction (as shown in FIG. 10).

Step S13: a plurality of the encapsulation colloids 115 of each LED string light 110 are interlaced with the two auxiliary wires 120 on both sides of the LED string light 110 through the connecting member 130 along the axial direction of the LED string light 110 in sequence, to form a meshwork structure. The details are as follows.

Figure 11:
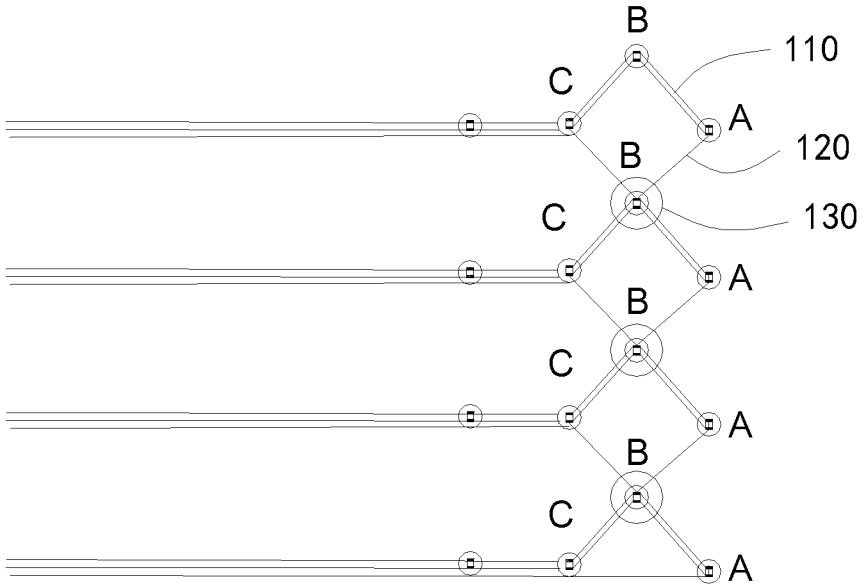
Figure 12:
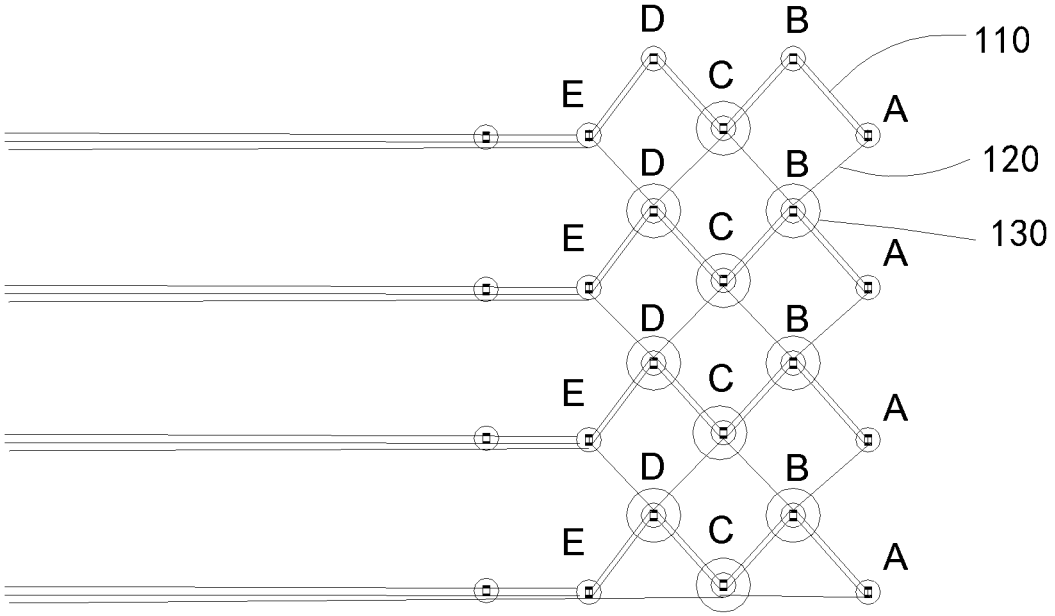

As shown in FIG. 11, the lamp bead A and the lamp bead C are respectively fixed by a fixture (not shown); one robot arm clamps the lamp bead B and the auxiliary wire 120 while the other robot arm draws the connecting member 130 and snaps the lamp bead B and the auxiliary wire 120 into the connecting member 130, thereby completing the connection of the lamp bead B and the auxiliary wire 120 on one side; and then, the connecting member 130 at the lamp bead B and the lamp bead D are respectively fixed by fixtures, one robot arm clamps the lamp bead C and the auxiliary wire 120 while the other robot arm draws the connecting member 130, and snaps the lamp bead C and the auxiliary wire 120 into the connecting member 130, thereby completing the connection of the lamp bead C and the auxiliary wire 120 on the other side (as shown in FIG. 12). In such a cycle, the production of the LED meshwork lamp is completed.

Figure 13:
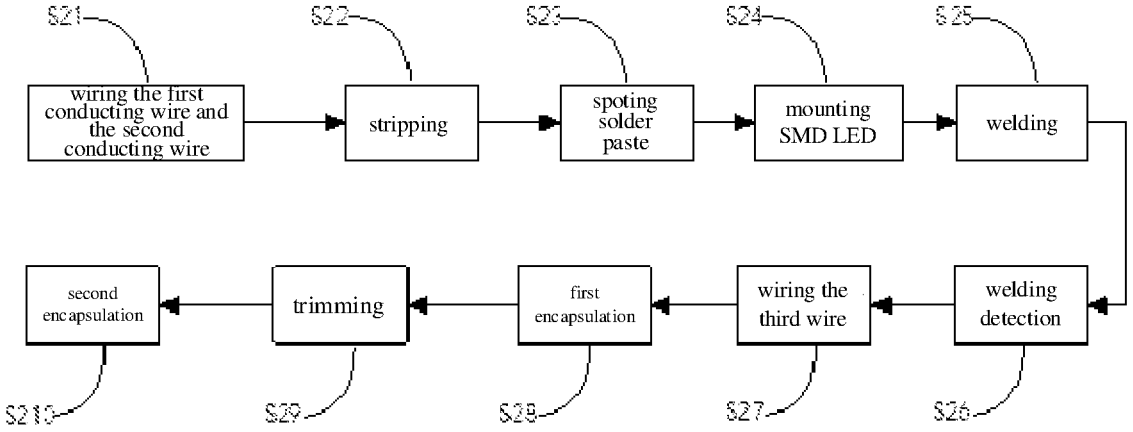
FIG. 13 is a flow chart of a production method for an LED string light of an LED meshwork lamp according to an embodiment of the present disclosure.

FIG. 13 is a flow chart of the production method for the LED string light 110 of the LED meshwork lamp 100 according to an embodiment of the present disclosure. As shown in FIG. 13, the production method for the LED string light 110 includes the following steps:

Step S21: the first conducting wire 111 and the second conducting wire 112 are wired; and the first conducting wire 111 and the second conducting wire 112 are wired in parallel through wiring mechanisms of the first wire 111 and the second wire 112.

Step S22: wire stripping is performed. Specifically, the first conducting wire 111 and the second conducting wire 112 are transported to the wire-stripping station through a wire transportation mechanism; the insulation layer on the surface of the first conducting wire 111 is removed at intervals of a predetermined length through the wire-stripping mechanism to form a first welding spot, and similarly, the insulation layer on the second conducting wire 112 is removed at intervals of a predetermined length through the wire-stripping mechanism to form a second welding spot, and the position of the first welding spot corresponds to the position of the second welding spot.

Step S23: a welding material is spot-welded. The first welding spot and the second welding spot are transported to the spot-welding material stations through a wire transportation mechanism, and the welding material is coated on the surfaces of the first welding spot of the first conducting wire 111 and the second welding spot of the second wire 112 by a spot-welding material mechanism. The welding material in the present embodiment is a solder paste.

Step S24: the SMD LED 114 is mounted. Specifically, the first welding spot and the second welding spot coated with the welding material on the surfaces thereof are transported to the LED mounting stations through the wire transportation mechanism, and the two welding legs of the SMD LED 114 are respectively mounted on the first welding spot and the second welding spot by an LED placement mechanism.

Step S25, welding is performed. Specifically, the SMD LEDs 114 placed on the first welding spot and the second welding spot are transported to the welding stations through the wire transportation mechanism, and the two welding legs of the SMD LED 114 are respectively welded to the first welding spot of the first conducting wire 111 and the second welding spot of the second wire 112 by a welding mechanism;

Step S26: welding is detected. Specifically, the welded SMD LED 114 is transported to the welding detection station through the wire transportation mechanism, to detect the welding quality of the SMD LED 114 through the welding detection mechanism;

Step S27: the third conducting wire 113 is wired in parallel to the first conducting wire 111 and the second conducting wire 112 through the wiring mechanism of the third conducting wire 113.

Step S28: a first encapsulation is performed. Specifically, the third conducting wire 113 and the detected SMD LED 114 are transported to a first encapsulation station through the wire transportation mechanism, and the SMD LED 114 and a portion of the third conducting wire 113 corresponding to the SMD LED 114 are encapsulated in the encapsulation colloid through a first encapsulation mechanism to form a lamp bead.

Step S29: the wire is cut off. The lamp beads are transported to the wire cutting station through the wire transportation mechanism, to determine whether the wire is cut by the wire cutting mechanism; if yes, the first conducting wire 111 or the second conducting wire 112 between two adjacent lamp beads is cut off; if not, the first conducting wire 111 or the second conducting wire 112 between the two adjacent lamp beads is not cut off;

Step S210: the second encapsulation is performed. Specifically, the lamp bead is transported to a second encapsulation station through the wire transportation mechanism; if the first conducting wire 111 or the second conducting wire 112 between the two adjacent lamp beads is cut, the lamp bead and a wire end formed by cutting the first conducting wire or the second conducting wire are encapsulated in the encapsulation colloid through the second encapsulation mechanism.

The LED meshwork lamp 100 production method provided by the present disclosure is suitable for automatic production of series, parallel or hybrid string, which is beneficial for reducing labor cost, reducing labor intensity, effectively improving production efficiency, and improving the finished product quality of the string; furthermore, the produced meshwork lamp can be powered by high voltage or low voltage, which expands the power supply condition of the meshwork lamp power supply and broadens the usage occasion of the meshwork lamp.

The above-mentioned embodiments merely illustrate several examples of the present disclosure, and the description thereof is more specific and detailed, but is not to be construed as limiting the scope of the present disclosure. It should be noted that a number of variations and modifications may be made by those skilled in the art without departing from the scope of the present disclosure, which are all within the scope of protection of the present disclosure.

What is claimed is:

1. An LED meshwork lamp, comprising:

at least two LED string lights arranged in parallel along a lateral direction, wherein, each LED string light comprises a first conducting wire, a second conducting wire, a third conducting wire, a plurality of Surface Mounted Devices (SMD) LEDs and a plurality of encapsulation colloids; the first conducting wire, the second conducting wire and the third conducting wire are arranged in parallel along a lateral direction or intertwisted together; the first conducting wire, the second conducting wire and the third conducting wire all include a conducting wire core and an insulation layer covering a surface of the conducting wire core; the insulation layer on the first conducting wire is removed at intervals of a predetermined length along an axial direction of the first conducting wire to form a plurality of first welding spots, the insulation layer on the second wire is removed at intervals of the predetermined length along an axial direction of the second conducting wire to form a plurality of second welding spots; positions of the plurality of the second welding spots correspond to positions of the plurality of the first welding spots one to one to form a plurality of lamp-welding areas; the plurality of the SMD LEDs are respectively disposed in the plurality of lamp-welding areas, two welding legs of each of the SMD LEDs are respectively welded to the first welding spot and the second welding spot of a corresponding lamp-welding area; the plurality of the SMD LEDs are connected in a parallel mode, a series mode or a hybrid mode; the plurality of encapsulation colloids respectively cover the plurality of SMD LEDs and surfaces of portions of the third conducting wire corresponding to positions of the plurality of SMD LEDs, to form a plurality of lamp beads;

at least two auxiliary wires, the at least two auxiliary wires and the at least two LED string lights being alternately arranged one by one in parallel and spaced apart along the lateral direction; and a plurality of connecting members, configured to interlace the plurality of the lamp beads of each LED string light to the two auxiliary wires on both sides of the each LED string light to form a meshwork structure.

2. The LED meshwork lamp according to claim 1, wherein positive-pole and negative-pole positions of two adjacent SMD LEDs are arranged in an opposite direction, and the first conducting wire and the second conducting wire between every two adjacent SMD LEDs are alternately cut off, such that a plurality of the SMD LEDs are connected in series, and wire ends formed by cutting the first conducting wire and the second conducting wire are encapsulated in the encapsulation colloid.

3. The LED meshwork lamp according to claim 1, wherein every at least two adjacent SMD LEDs constitute one light-emitting unit, positive-pole and negative-pole positions of each SMD LED in each light-emitting unit are arranged in a same direction, positive-pole and negative-pole positions of two adjacent light-emitting units are arranged in an opposite direction; the first conducting wire and the second conducting wire between every two adjacent light-emitting units are alternately cut off, such that the plurality of the SMD LEDs are connected in a hybrid mode, and wire ends formed by cutting the first conducting wire and the second conducting wire are encapsulated in the encapsulation colloid.

4. The LED meshwork lamp according to claim 1, wherein positive-pole and negative-pole positions of the plurality of the SMD LEDs are arranged in a same direction, such that the plurality of the SMD LEDs are connected in parallel, and the third conducting wire is connected to the first conducting wire or the second conducting wire through at least one jumper wire bridged between the third conducting wire and the first conducting wire or the second conducting wire.

5. The LED meshwork lamp according to claim 1, wherein the connecting member comprises a fixing portion which is provided with a snapping slot matching the lamp bead, the lamp bead and the auxiliary wire are snapped into the snapping slot.

6. The LED meshwork lamp according to claim 5, wherein the lamp bead and the auxiliary wire are fixed to the snapping slot by glue.

7. The LED meshwork lamp according to claim 5, wherein the connecting member further comprises a decoration portion, and the decoration portion is connected to the fixing portion.

8. The LED meshwork lamp according to claim 1, wherein the first conducting wire, the second conducting wire, and the third conducting wire are enamel-covered wires or rubber-covered wires.

9. A production method for an LED meshwork lamp, comprising:

providing at least two LED string lights which are arranged in parallel along a lateral direction; each LED string light comprises a first conducting wire, a second conducting wire, a third conducting wire, a plurality of Surface Mounted Devices (SMD) LEDs and a plurality of encapsulation colloids; the first conducting wire, the second conducting wire and the third conducting wire are arranged in parallel along a lateral direction or intertwisted together; the first conducting wire, the second conducting wire and the third conducting wire all comprise a conducting wire core and an insulation layer covering a surface of the conducting wire core; the insulation layer on the first conducting wire is removed at intervals of a predetermined length in an axis direction of the first conducting wire to form a plurality of first welding spots, the insulation layer on the second conducting wire is removed at intervals of a predetermined length in an axis direction of the second conducting wire to form a plurality of second welding spots; positions of the plurality of the second welding spots correspond to positions of the plurality of the first welding spots one to one, to form a plurality of lamp welding areas; the plurality of the SMD LEDs are respectively disposed in the plurality of the lamp welding areas, and two welding legs of each SMD LED are respectively welded to the first welding spot and the second welding spot of a corresponding lamp welding area; the plurality of the SMD LEDs are connected in a parallel mode, a series mode or a hybrid mode; the plurality of the encapsulation colloids respectively cover the plurality of the SMD LEDs and surfaces of portions of the third conducting wire corresponding to positions of the plurality of the SMD LEDs to form a plurality of lamp beads;

providing at least two auxiliary wires, wherein the at least two auxiliary wires and the at least two and the at least two LED string lights are alternately arranged one by one and spaced apart along the lateral direction; and interlacing the plurality of the lamp beads of each LED string light with the two auxiliary wires on both sides of the LED string light along an axial direction of the LED string light in sequence, to form a meshwork structure.

10. The production method for an LED meshwork lamp according to claim 9, wherein the providing at least two LED string lights comprises:

wiring the first conducting wire and the second conducting wire in parallel through wiring mechanisms of the first conducting wire and the second conducting wire;

transporting the first conducting wire and the second conducting wire to wire-stripping stations by a wire transportation mechanism, removing insulation layer on the first conducting wire at intervals of a predetermined length through a wire-stripping mechanism to form a first welding spot; removing insulation layer on the second conducting wire at intervals of a predetermined length through a wire-stripping mechanism to form a second welding spot; and a position of the first welding spot corresponds to a position of the second welding spot;

transporting the first welding spot and the second welding spot to spot-welding material stations through the wire transportation mechanism, and coating a welding material on surfaces of the first welding spot and the second welding spot through the spot-welding material mechanism;

transporting the first welding spot and the second welding spot coated with the welding material on the surfaces thereof to LED mounting stations through the wire transportation mechanism, and placing two welding legs of each SMD LED on the first welding spot and the second welding spot respectively through an LED placement mechanism;

transporting the each SMD LED placed on the first welding spot and the second welding spot to welding stations through the wire transportation mechanism, and welding the two welding legs of the each SMD LED to the first welding spot and the second welding spot respectively through a welding mechanism;

transporting the each welded SMD LED to a welding detection station through the wire transportation mechanism, to detect a welding quality of the each SMD LED through a welding detection mechanism;

wiring the third conducting wire in parallel to the first conducting wire and the second conducting wire through a wiring mechanism of the third conducting wire; transporting the each detected SMD LED and the third conducting wire to a first encapsulation station through the wire transportation mechanism encapsulating the SMD LED and a portion of the third conducting wire corresponding to a position of the each SMD LED into the encapsulation colloid through a first encapsulation mechanism, to form a lamp bead;

transporting the lamp bead to a cutting station through the wire transportation mechanism, and determining through a wire cutting mechanism whether to cut wires t; if yes, the first conducting wire or the second conducting wire between two adjacent lamp beads is cut; if not, the first conducting wire or the second conducting wire between the two adjacent lamp beads is not cut; and transporting the lamp bead to a second encapsulation station through the wire transportation mechanism; if the first conducting wire or the second conducting wire between the two adjacent lamp beads is cut, encapsulating, through a second encapsulation mechanism, the lamp bead and a wire end formed by cutting the first conducting wire or the second conducting wire together in the encapsulation colloid.

* * * * *